US010519399B2

(12) United States Patent
Campbell et al.

(10) Patent No.: US 10,519,399 B2
(45) Date of Patent: Dec. 31, 2019

(54) CANDLE WITH SCENT

(71) Applicants: Lucy M. Campbell, Jupiter, FL (US); A. Keith Campbell, Jupiter, FL (US)

(72) Inventors: Lucy M. Campbell, Jupiter, FL (US); A. Keith Campbell, Jupiter, FL (US)

( * ) Notice: Subject to any disclaimer, the term of this patent is extended or adjusted under 35 U.S.C. 154(b) by 0 days.

(21) Appl. No.: 15/971,626

(22) Filed: May 4, 2018

(65) Prior Publication Data

US 2018/0312778 A1 Nov. 1, 2018

(51) Int. Cl.
*C11C 5/00* (2006.01)
*F23D 3/16* (2006.01)

(52) U.S. Cl.
CPC ..... *C11C 5/008* (2013.01); *C11C 5/002* (2013.01); *C11C 5/006* (2013.01); *F23D 3/16* (2013.01)

(58) Field of Classification Search
CPC ..... C11C 5/008; C11C 5/002; C11C 5/006; C11C 5/025; C11C 5/00; F23D 3/16
USPC ..... 431/289, 102, 4
See application file for complete search history.

(56) References Cited

U.S. PATENT DOCUMENTS 3,175,876 A 3/1965 Fredericks
3,958,917 A 5/1976 Naz
4,028,045 A * 6/1977 Reiher ..... C11C 5/008 431/289
4,054,636 A 10/1977 Menig
4,386,904 A * 6/1983 Miyahara ..... C11C 5/006 431/126
4,427,366 A * 1/1984 Moore ..... A61L 9/03 422/126
5,891,400 A * 4/1999 Ansari ..... A01M 1/2088 422/122
6,068,472 A * 5/2000 Freeman ..... C11C 5/002 431/288
6,086,853 A 7/2000 Michaels
6,214,295 B1 * 4/2001 Freeman ..... C11C 5/002 422/126
6,241,512 B1 * 6/2001 Freeman ..... C11C 5/002 431/291
6,544,303 B2 4/2003 Calzada
6,551,099 B1 4/2003 Kapinski
6,630,110 B2 10/2003 Urfig
6,769,905 B2 8/2004 Gray et al.
6,783,356 B2 8/2004 Hermanson
6,849,240 B2 2/2005 Nakatsu et al.
7,195,739 B1 3/2007 Penman et al.
7,220,288 B2 5/2007 D'Amico et al.
7,291,187 B2 11/2007 Welch et al.
(Continued)

FOREIGN PATENT DOCUMENTS

FR 2639356 A1 * 5/1990 ..... C11C 5/004
GB 2229734 A * 10/1990 ..... C11C 5/002
(Continued)

OTHER PUBLICATIONS

"Search polyvinyl alcohol exposed to flame—Bing 2019-10-08.pdf", online search, http://bing.com, Oct. 8, 2019.*

*Primary Examiner* — Steven B McAllister
*Assistant Examiner* — Daniel E. Namay
(74) *Attorney, Agent, or Firm* — McHale & Slavin, P.A.

(57) ABSTRACT

A scented candle is provided. The candle has a body made of a flammable material and a wick. The body of the candle is provided with one or more bores adapted for receiving a respective scent element therein as selected by a user.

15 Claims, 2 Drawing Sheets

(56) References Cited

U.S. PATENT DOCUMENTS 7,637,738 B2 12/2009 Conover
7,959,689 B2 6/2011 Cagle
8,371,740 B2 2/2013 Pestl et al.
8,485,814 B2 7/2013 Jobelius et al.
8,651,855 B2 2/2014 Cagle et al.
9,249,375 B2 2/2016 Jobelius et al.
9,441,186 B2 9/2016 Cagle et al.
10,385,213 B2 * 8/2019 Wood ..... C08K 5/47
10,435,645 B2 * 10/2019 Jones ..... C07C 69/757
2002/0068251 A1 * 6/2002 Steck ..... B44C 1/17 431/288
2002/0102187 A1 * 8/2002 Bellenger ..... A61L 9/035 422/126
2002/0102508 A1 * 8/2002 LaVanier ..... F21S 13/12 431/291
2002/0195743 A1 * 12/2002 Wu ..... C11C 5/008 264/255
2003/0049578 A1 * 3/2003 Freeman ..... C11C 5/008 431/291
2003/0099914 A1 * 5/2003 Yao ..... C11C 5/008 431/291
2003/0162142 A1 * 8/2003 Bennetts ..... C11C 5/008 431/291
2005/0037308 A1 * 2/2005 Decker ..... F23D 3/16 431/325
2005/0163649 A1 * 7/2005 Friedrich ..... A61L 9/02 422/1
2005/0164141 A1 * 7/2005 Paasch ..... F23D 3/18 431/325
2006/0075679 A1 * 4/2006 Cap ..... C08L 91/06 44/275
2008/0083150 A1 * 4/2008 Palozzi ..... A01M 31/008 43/1
2009/0170046 A1 * 7/2009 Wooten ..... F23D 3/16 431/289
2011/0300496 A1 * 12/2011 Cagle ..... C11C 5/002 431/289
2012/0222347 A1 * 9/2012 Clock ..... C11C 3/006 44/275
2013/0065051 A1 * 3/2013 Chen ..... C08K 5/52 428/375
2013/0209946 A1 * 8/2013 George ..... C11C 5/002 431/289
2014/0199646 A1 * 7/2014 Beadles ..... C11C 5/002 431/288
2016/0046889 A1 * 2/2016 Tyson ..... C11C 5/002 44/275
2016/0257909 A1 * 9/2016 Lee ..... C11C 5/002
2017/0146229 A1 * 5/2017 Kercher, III ..... F21V 35/00
2017/0175033 A1 * 6/2017 Schroder ..... C11C 5/028
2017/0175034 A1 * 6/2017 Schroder ..... C11C 5/028
2017/0216166 A1 * 8/2017 Sasaki ..... A61Q 5/02
2018/0312778 A1 * 11/2018 Campbell ..... C11C 5/008
2019/0153354 A1 * 5/2019 Lankin ..... C07C 43/16
2019/0177653 A1 * 6/2019 Lombardo ..... A61K 8/33
2019/0184364 A1 * 6/2019 Brahms ..... A23L 27/72

FOREIGN PATENT DOCUMENTS

JP 2010285533 A * 12/2010
JP 2011202091 A * 10/2011
JP 2011202093 A * 10/2011

* cited by examiner

CANDLE WITH SCENT

FIELD OF THE INVENTION

The present invention relates to a candle with added scent elements.

BACKGROUND OF THE INVENTION

Candles are well known in the art. They have been used for millennia. A candle comprises a flammable substance, which is in solid form at room temperature, and a wick. In use, the flammable substance melts and then vaporizes from the heat of a flame on a wick. Capillary action allows the flammable substance to rise in the wick to be vaporized by the flame. It is the vapor that burns after an initial ignition of the wick.

Wikipedia describes a candle as " . . . an ignitable wick embedded in wax or another flammable solid substance, such as tallow, that provides light and, in some cases, a fragrance. It can also be used to provide heat, or used as a method of keeping time." Various devices have been invented to hold candles, from simple tabletop candle holders to elaborate chandeliers. For a candle to burn, a heat source (commonly a naked flame) is used to light the candle's wick, which melts and vaporizes a small amount of fuel (the wax). Once vaporized, the fuel combines with oxygen in the atmosphere to ignite and form a constant flame. This flame provides sufficient heat to keep the candle burning via a self-sustaining chain of events: the heat of the flame melts the top of the mass of solid fuel; the liquefied fuel then moves upward through the wick via capillary action; the liquefied fuel finally vaporizes to burn within the candle's flame. As the mass of solid fuel is melted and consumed, the candle becomes shorter. Portions of the wick that are not emitting vaporized fuel are consumed in the flame. The incineration of the wick limits the exposed length of the wick, thus maintaining a constant burning temperature and rate of fuel consumption. Some wicks require regular trimming with scissors (or a specialized wick trimmer), usually to about one-quarter inch (~0.7 cm), to promote slower, steady burning, and also to prevent smoking. In early times, the wick needed to be trimmed quite frequently. Special candle-scissors, referred to as "snuffers" were produced for this purpose in the 20th century and were often combined with an extinguisher. In modern candles, the wick is constructed so that it curves over as it burns. This ensures that the end of the wick gets oxygen and is then consumed by fire—a "self-trimming wick."

Originally, candles were made of tallow, e.g., beef fat, or other animal fat, and often formed by repeated dipping in liquid tallow to form additional layers of flammable or combustible substance that also forms the main body of the candle.

Beeswax has been used as the flammable material. Now, a commonly used wax is paraffin.

Scent material has also been added to the flammable material so that the burning candle can give off a scent. This has been referred to as aroma therapy. Added scent is typically a fragrant oil mixed with the flammable material and then solidified to form the solid candle body.

DESCRIPTION OF THE PRIOR ART

Many forms of candles are known that provide scent or aroma during burning of the candle. One form is to have a scent material incorporated into the flammable material that is volatized and released into the surrounding atmosphere by the candle flame.

Another example is disclosed in U.S. Pat. No. 6,551,099. This candle utilizes multiple integral layers for providing several fragrances and colors from just one candle. The multiple layered candle includes a layered wax material including a plurality of wax segments; and also includes a wick disposed in the layered wax material that extends the length thereof and has a top end portion which extends outwardly from the layered wax material.

A still further example is disclosed in U.S. Pat. No. 7,637,738. The disclosed candle has a first section with a first wax that melts at a first temperature, and a second section with a second wax with a fragrance that melts at a second temperature so that the candle can be manufactured to keep the first wax and the second wax separate during manufacture and storage, but so that the first wax and the second wax combine when burning. The second section can comprise multiple inner portions, each having their own unique fragrance, the candle being constructed so that the fragrances combine when the candle is burned.

SUMMARY OF THE INVENTION

The present invention involves the provision of a candle that, when burning, provides a selected scent or aroma to the surrounding atmosphere. The scent(s) may be mixed or regulated by adding or mixing scent rods to a candle blank having elongated bores for the addition of the scent rods.

Accordingly, it is a primary objective of the instant invention that can utilize separate components to form a complete candle.

It is a further objective of the instant invention that can be used to provide scent or not provide scent during candle burning as selected by a user.

It is yet another objective of the instant invention to provide a candle construction that allows a user to provide a selected scent at the time of candle burning.

Still another objective of the present invention is to provide a candle construction that allows the use of softer high scent rods within a standard wax type candle.

Still yet another objective of the present invention is to provide a candle construction that allows the use of low temperature melting rods of oils within a standard wax candle.

Other objects and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
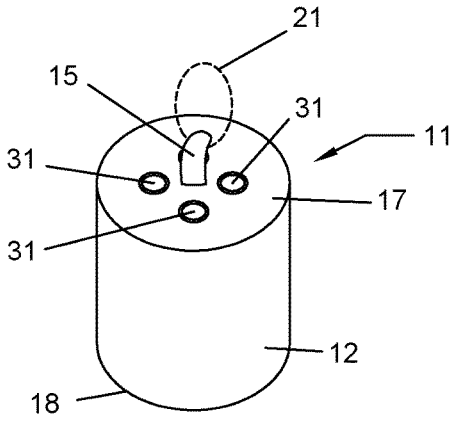
FIG. 1 is a perspective view of a candle.

FIG. 1 illustrates a candle 11 that provides scent or aroma to the surrounding atmosphere during burning of the candle. The candle 11 has a body 12 made of a flammable or combustible material, such as wax or fat, that can provide a solid body 12 at room temperature, approximately 70° F. The candle 11 includes a wick 15 embedded in the body 12 and extending from an upper end 17 of the body 12, providing an exposed portion 19 for lighting and burning. The candle 11 also has a lower end 18 usable to support the candle during use. Typically, a wick 15 extends generally longitudinally of the body 12 and is generally centrally located within the body 12. Such a wick 15 can be made of a braided fibrous material, such as cotton, as is known in the art. As described above in the Background, an ignition source, such as a match, is held close to the wick 15 until a flame 21 is created. The flame 21 melts or liquefies the flammable material of the body 12, then volatilizes the melted material, which then ignites and perpetuates the flame 21 by providing a combustible gas or liquid to the flame 21. The functioning of candles is well known in the art. The body 12 can be any suitable shape, such as generally cylindrical, tapered, carved on the exterior, or any other suitable shape. The body 12 can also be of any suitable size and color, or colors.

The body 12 can be made of any suitable combustible or flammable material, such as wax or fat, so long as it can form a structure that is solid at room temperature. Paraffin wax can be used, as well as animal fats and/or natural waxes, such as beeswax. It is to be understood that while a candle is a solid structure at room temperature, this does not preclude the material forming the body 12 from having liquids therein. Such combustible materials are generally a mixture of various molecular weight components. This is particularly true for animal fats.

Figure 2:
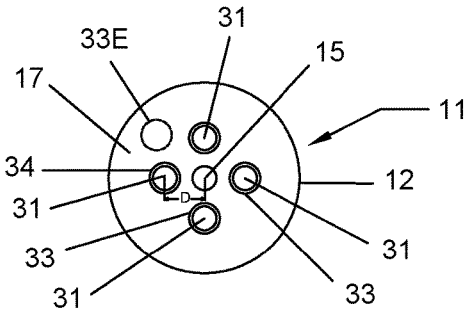
FIG. 2 is a top plan view of the candle of FIG. 1.
Figure 3:
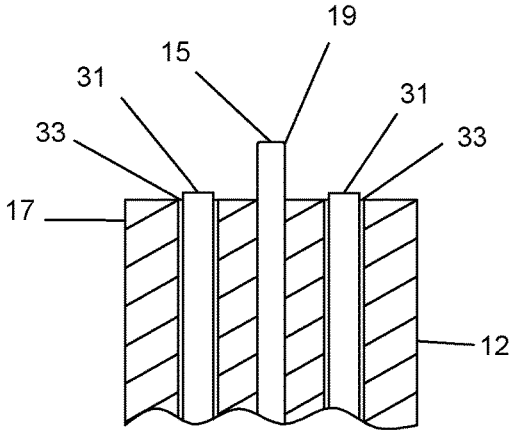
FIG. 3 is a fragmentary section view of the candle of FIG. 1.

The candle 11 is provided with one or more scent elements 31, as best seen in FIGS. 1-3. As shown, the body 12 has one or more bores 33 extending generally longitudinally of the body 12 and can be generally parallel to the wick 15 and open on the upper end adjacent the wick 15, while closed on the lower end. The term "bore" as used herein is not limited to having a round transverse cross section. The center of the bores 33 are spaced from the center of the wick 15 a distance sufficient to allow volatilization of scent producing components in the elements 31 from the heat of the flame 21. This distance D, FIG. 2, is on the order of about ¼" and about ¾". The bores 33 can be formed by any suitable method, such as drilling after the body 12 is formed or molding during forming of the body 12. The bores extend generally parallel to a longitudinal axis of the candle body, generally meaning within the bounds of the outer diameter of the candle. Preferably, the transverse cross-sectional shape of the bores 12 is generally round, although other shapes can be provided if desired. When round, the diameter of the bores 33 would be on the order of about ⅛" and about ¾". Other shapes should provide the same cross-sectional area as the above described round bores 33. Preferably, the bores 33 are closed at the ends thereof, adjacent the lower end 18. It is to be understood that the bores 33 could be provided with a liner 34, as shown in FIG. 2, if desired.

Figure 7:
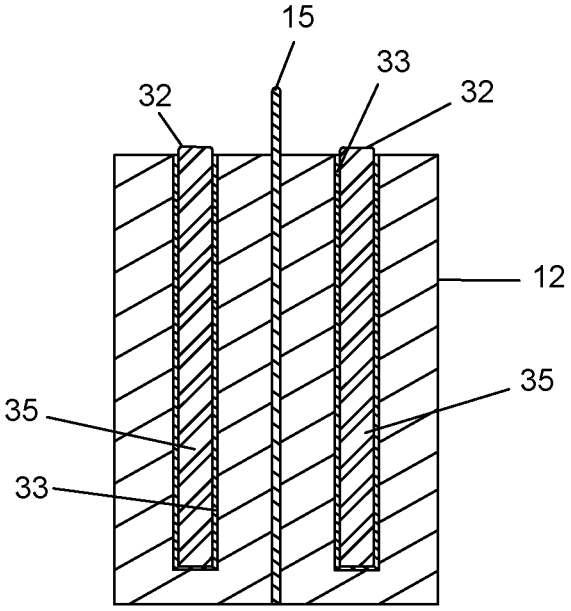
FIG. 7 is a sectional view of the candle of FIGS. 1 and 6, taken along the line 7-7 of FIG. 6 to illustrate details of the bores.

In a preferred embodiment, the scent elements 31 are in solid form at room temperature. As shown, they are in the form of a generally round rod and fit within the respective bore 33. They can be placed in the bore 33 by the user and can provide the same scent in each, a different scent in each, or a combination of the same and different scents as selected by the user. The scent contained in an element 31 can be volatilized by the heat of the flame 21. Preferably, the elements 31 are consumed by the flame 21 during use. One scent element 31 found to be usable is a high scent oil containing wax, having a low melting point. A scent element 31 is preferably smaller than the bore 33 so that a user can simply install them or remove them as desired. This allows for a user to select one or more desired scents, or a no scent element, when burning the candle 11, and to change the scents for another candle burning session. In at least one alternative embodiment, the elements 31 melt into place and mix with the wax from the body 12. While the scent element 31 is described above as being in solid form, it is to be understood that a liquid form of scent element 31 can be used. This can be accomplished by simply pouring a liquid scent into a bore 33. As the candle 11 decreases in length during burning, the scent elements 31 will be consumed by the flame 21. It is to be understood that a scent element 31 in solid form can have different scents provided along different sections of the length thereof. It is also to be understood that an element 31 can be in the form of a liquid (at room temperature) scent material 35 encapsulated initially in a solid closed shell 32; the shell being made of a material that will melt when the flame 21 is present to expose the scent material to the flame heat for volatilization and release, FIG. 7. The encapsulated liquid is denoted as a solid by encapsulation to differentiate it from a fully solid element 31. A suitable shell material can be a tristearin that is solid at room temperature, but will melt in the presence of a candle flame 21.

Figure 5:
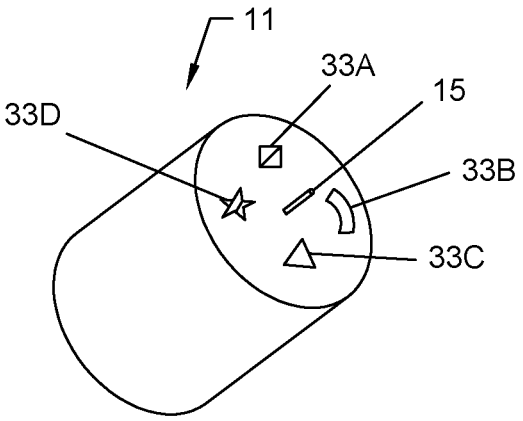
FIG. 5 is a perspective view showing the candle having various cross-sectionally shaped bores for holding similarly shaped scent elements.
Figure 6:
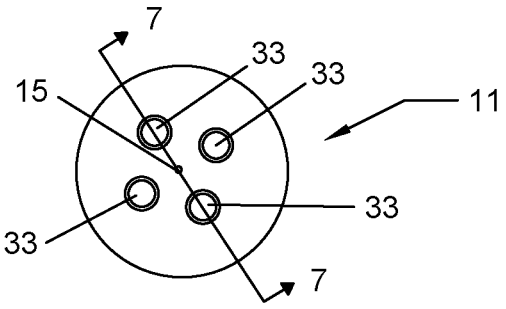
FIG. 6 is a top plan view of the candle of FIG. 1.

FIG. 5 illustrates a candle 11 having bores 33 of various transverse cross-sectional shapes. Bore 33A is rectangular, bore 33B is arched, bore 33C is triangular, and bore 33D is star shaped. These shapes can be used to designate a particular scent if desired. The bores may all have a like shape or they may all be different with respect to each other without departing from the scope of the invention.

Figure 4:
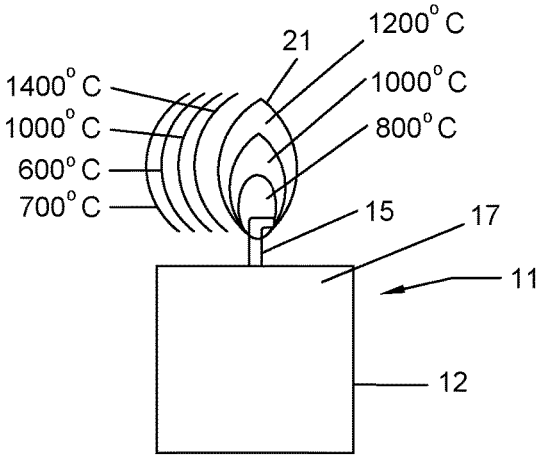
FIG. 4 is a schematic representation of a candle flame showing a temperature profile of the flame and surrounding area.

FIG. 4 provides a graphic representation of a temperature profile of a candle flame 21. As can be seen, the flame's temperature increases upwardly and outwardly, and then, outside the flame, the atmospheric temperature decreases exponentially with increasing distance. Thus, different volatile components for the scent elements 31 can be selected and positioned for improved performance. The bores 33 are shown as being an equal distance from the wick 15, but it is to be understood that additional bores can be provided at different distances from the wick 15 to accommodate different scents, such as bore 33E as shown in FIG. 2 in dashed lines.

The candle body 12 and scent elements 31 can be sold in kit form or separately, and the user can configure the candle 11 in any desired configuration.

It is to be understood that while certain forms of the invention are illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A candle comprising:

a body made of a flammable material, said body being a solid at room temperature and having an upper end;

a wick disposed within said body and having an end portion extending beyond the upper end of said body;

at least one bore formed in said body and extending along a portion of the length of said body and opening on the upper end of said body, said bore having a central axis spaced from a central axis of the wick a distance D in the range of between about ¼" and about ¾", said bore being adapted to contain at least one scent element;

a scent element disposed within said at least one said bore, said scent element being in the form of a liquid at room temperature, said liquid encapsulated in a solid closed shell, said shell sized and shaped to fit within said bore, said shell constructed of a material that is in solid form at room temperature and will melt in the presence of a candle flame to expose said scent element to said candle flame for release, said shell material mixing with said candle body for volatilization therewith.

2. The candle as set forth in claim 1 wherein there being a plurality of said at least one bore in said body.

3. The candle as set forth in claim 2 wherein said plurality of said bores each having a respective scent element therein.

4. The candle as set forth in claim 3 wherein the body comprising a wax material.

5. The candle as set forth in claim 1 wherein said at least one bore is round.

6. The candle as set forth in claim 1 wherein said bore includes a polygon shape.

7. The candle as set forth in claim 1 wherein said solid shell is formed of tristearin.

8. A scented candle kit comprising:

a candle body, said candle body formed of a flammable material that is solid at room temperature;

said body including at least two hollow bores extending generally parallel to a longitudinal axis of said candle body;

said candle body having a wick extending through said candle body, said wick formed from a flammable material, an upper portion of said wick extending above a top surface of said candle body;

a first hollow bore of said two hollow bores being positioned a first distance from said wick, a second hollow bore of said two hollow bores being positioned a second further distance from said wick;

at least one first scent element having a longitudinal axis and a cross-sectional shape, said cross-sectional shape sized to fit within said at least one first hollow bore, said first scent element including a first scent component that is volatile at a first temperature, at least one second scent element having a longitudinal axis and a cross-sectional shape, said cross-sectional shape sized to fit within said at least one second hollow bore, said second scent element having a second scent component that is volatile at a second temperature, at least one of said first or said second scent elements being in the form of a liquid at room temperature, said liquid encapsulated in a material that is solid at room temperature to form a solid closed shell enclosing said liquid, said solid closed shell being made of a material that will melt in the presence of a candle flame to expose said liquid to said candle flame for volatilization, said solid closed shell volatizing with said candle body.

9. The kit of claim 8 wherein said candle body includes a plurality of said first hollow bores, said kit including at least one said scent element for each said first hollow bore, said candle body includes a plurality of said second hollow bores, said kit including at least one said scent element for each said second hollow bore.

10. The kit of claim 9 wherein said plurality of scent bores includes more than one cross-sectional shape and said scent elements are provided with conjugate cross-sectional shapes.

11. The kit of claim 9 wherein a portion of said scent elements are devoid of scent.

12. The kit of claim 8 wherein said candle body and said first scent element have different melting temperatures.

13. The kit of claim 12 wherein said solid closed shell of said first scent element has a lower melting temperature than said candle body.

14. The kit of claim 8 wherein said body is substantially devoid of scent other than the natural scent of the material from which said candle body is constructed.

15. The kit of claim 8 wherein said solid closed shell portion of said scent element is constructed from tristearin.

* * * * *